United States Patent [19]

Fritz

[11] Patent Number: 4,774,034

[45] Date of Patent: Sep. 27, 1988

[54] CLIP FOR ATTACHING SPLASH BARS TO COOLING TOWER FILL SUPPORT GRID

[75] Inventor: Gerald D. Fritz, Raytown, Mo.

[73] Assignee: The Marley Cooling Tower Company, Mission, Kans.

[21] Appl. No.: 101,144

[22] Filed: Sep. 25, 1987

[51] Int. Cl.[4] ..... B01F 3/04

[52] U.S. Cl. ..... 261/111; 261/DIG. 11

[58] Field of Search ..... 261/111, DIG. 11

[56] References Cited

U.S. PATENT DOCUMENTS

| | | | |
|---|---|---|---|
| 4,115,484 | 9/1978 | Saxton | 261/111 |
| 4,576,764 | 3/1986 | Shepherd et al. | 261/111 |
| 4,663,092 | 5/1987 | Kinney, Jr. et al. | 261/111 |

*Primary Examiner*—Tim Miles

*Attorney, Agent, or Firm*—Hovey, Williams, Timmons & Collins

[57] ABSTRACT

A clip for securing splash bars of a cooling tower fill structure to supporting grids is adapted to receive grid members having different cross-sectional configurations. Opposed, depending legs of the clip are connected to tabs that normally project into a channel receiving a section of the grid member, in order to reduce the cross-sectional area of the channel in instances where the grid member has a relatively small transverse configuration. The tabs are resilient and hence deflectable in a lateral direction to enlarge the available transverse area of the channel as may be necessary to receive sections of grid members having larger cross-sectional configurations. In preferred embodiments, the clip is integrally molded of a synthetic resinous material and the tabs are relatively thin to enable the tabs to self-deflect in a lateral direction as the clip is installed onto a larger grid member. A lower edge portion of each tab is inclined relative to vertical to facilitate lateral deflection of the tab as the edge portion comes into contact with the grid member during installation of the clip.

7 Claims, 2 Drawing Sheets

CLIP FOR ATTACHING SPLASH BARS TO COOLING TOWER FILL SUPPORT GRID

BACKGROUND OF THE INVENTION

1. Field of the Invention

This invention relates generally to the field of water cooling towers and especially to an improved clip for securing horizontal bars of a splash type fill assembly to respective supporting grid members which are a part of upright, horizontally spaced fill support grids. In particular, the invention is concerned with clips that are useful without modification in the field to secure water cooling tower splash bars to grids which have support grid members of varying cross-sectional shape and dimensions.

Specifically, the invention concerns a clip having structure defining a channel for receiving the horizontal grid member of an upright support grid and a number of deflectable elements or tabs connected to the channel defining structure which serve to lock the clip to the grid member. The tabs are constructed and arranged such that they deflect to an extent as may be necessary to accomodate grid members of different dimensions while at the same time adapt to grid members of round as well as cross-sectional elongated shapes. In preferred forms of the invention, the clip is integrally molded of a synthetic resinous material and the tabs are relatively thin and resilient for self-deflecting away from the position projecting into the channel as the clip is installed onto larger grid members.

2. Description of the Prior Art

Industrial evaporative water cooling towers of the crossflow type have long been provided with splash fill structure comprising an array of horizontally extending slats or bars. Hot water to be cooled is primarily in the form of droplets or small streams which discharge from a distribution system overlying the fill structure and fall onto and directly impact the upper faces of the splash bars. As the water droplets contact the splash bars, the hot water is further dispersed and even smaller drops are formed to facilitate the cooling process. Simultaneously, cooling air currents are drawn in essentially a horizontal pattern through the fill structure, either by means of motor driven fans or through use of a natural draft-inducing hyperbolic tower for intimate, interactive thermal exchange with the descending water drops before the latter are ultimately collected in a cold water basin underlying the fill structure.

Splash bars of a crossflow cooling tower should remain in a straight, horizontal orientation for optimum performance of the tower. If the bars tend to sag, uniform hot water and cooling air distribution throughout the fill structure is disrupted and the effectiveness of the tower will be impaired. To avoid this problem, a plurality of upright grids having horizontal splash bar supporting members are spaced on centers small enough to prevent the splash bars from sagging under normal conditions.

It has also long been recognized that the motor, fan and connecting drive shafts of mechanical draft towers transmit a certain amount of vibration to other components of the tower including the splash bars and the supporting grids, tending to dislodge the splash bars from their initial positions. Air flow through the fill structure and impingement of water at various angles against the fill bars tend to aggravate the tendency of the splash bars to shift from their desired disposition.

Over a period of time, interengaging portions of the horizontal supporting grid members and the bars may also abrade unless relative movement between the same is precluded. As a consequence, it has been the practice to utilize coupling devices for securing each splash bar to its underlying, horizontal support section of the adjacent grid. Representative coupling devices have taken the form of synthetic resinous clips provided with upper wall portions located to engage adjacent regions of the splash bar, a horizontally extending portion intermediate the bottom of the bar and the top of the horizontal grid member section to prevent rubbing contact between the bar and the grid, and legs depending from the horizontal portion in disposition to receive a respective horizontal grid member.

Certain types of clips for attaching splash bars to fill support grids have incorporated depending pairs of opposed legs which are cooperable with the intermediate, horizontal portion of the clip to define a channel for receiving the horizontal grid section. The legs of such clips, in more detail, extend downwardly in a vertical direction from the horizontal portion of the clip a certain distance, and then extend at an angle relative to vertical to present an inverted V-shaped profile when viewing the legs from one end of the clip. In addition, each leg includes a protuberance located at the intersection of the inclined portion and the vertical portion; the protuberances of each pair of legs, when viewed from the end of the clip, project toward each other to define the bottom of the channel that receives the grid member section.

Clips as described above, have for the most part been integrally molded of a synthetic resinous material so that they have a degree of inherent resiliency. As a consequence, the legs of the clip are deflectable in a direction away from each other when installed on the grid member section to enable the latter to pass through the narrowed region presented between the protuberances and be received in the larger, overlying channel. Thereafter, the resilient legs return toward one another so that the protuberances function to retain the clip and the splash bar supported thereby on the horizontal bar section of the grid.

In many instances, the splash bar supporting grids are comprised of a non-deteriorating glass fiber reinforced polyester (GRP) material which has been found to provide satisfactory service over extended periods of time. In other cases, though, the supporting grid may take the form of stainless steel rods or bars that are welded together in a lattice-type arrangement. However, the transverse cross-sectional area of a stainless steel grid member is usually considerably smaller than the transverse area of a grid member fabricated from glass reinforced polyester. GRP grids on the other hand are also of elongated transverse shape rather than being truly round as in the case of steel grids, further complicating the task of providing a universally usable splash bar clip.

In the past, it has been the common practice of tower manufacturers and installers to retain on hand two varieties of clips for securing certain splash bars to the supporting grids. The legs of one variety of clip were formed to present a channel sufficiently large for receiving a section of a grid fabricated from glass reinforced polyester materials. The other variety of clip had legs presenting a somewhat smaller channel complemental in configuration to the cylindrical shape of the stainless steel grid members. In this manner, a clip could be selected in accordance with the type of fill structure employed, with the result that the channel presented by the selected clip would be of a proper configuration for receiving the chosen type of grid in close contact with the same.

One problem associated with the use of two varieties of clips, however, is the necessity of manufacturing, handling and stocking a sufficient quantity of each clip. Therefore, it would be advantageous to provide a single clip which is adapted to readily accommodate and receive sections of grid members of different diameters and having substantially different configurations in transverse cross-section.

SUMMARY OF THE INVENTION

The present invention is directed toward a splash bar retaining clip which may be affixed to a selected one of a number of grid members having different transverse dimension and cross-sectional configurations within a selected range thereof. Thus, only one type of clip need be manufactured with attendant cost savings and customer convenience in reduced parts stocking.

The clip in accordance with the invention is provided with relatively thin elements or tabs that are integrally connected to opposed, depending legs forming a part of the clip. Each of the tabs is biased toward an orientation projecting into a channel defined by the legs for receiving the grid member in order to reduce the free cross-sectional area of the channel in towers where stainless steel grids are employed. The tabs are readily deflectable in a lateral direction, however, as may be necessary to increase the available cross-sectional area of the channel in cases where the tower is provided with larger, transversely elongated grid members such as those fabricated from glass reinforced polyester materials.

In preferred forms of the invention, an upper edge of each tab is spaced from an overlying, adjacent horizontal portion of the clip so that the stainless steel grid member may be received in the space between the top of the tab and the bottom of the horizontal portion. The tabs are relatively thin in cross section and consequently are self-deflectable away from each other when the legs of the channel are pushed over glass reinforced polyester grid members such that neither the attention nor the assistance of the workman is needed in order to adapt and secure the clip to the selected type of grid.

DETAILED DESCRIPTION OF THE DRAWINGS

Figure 1:
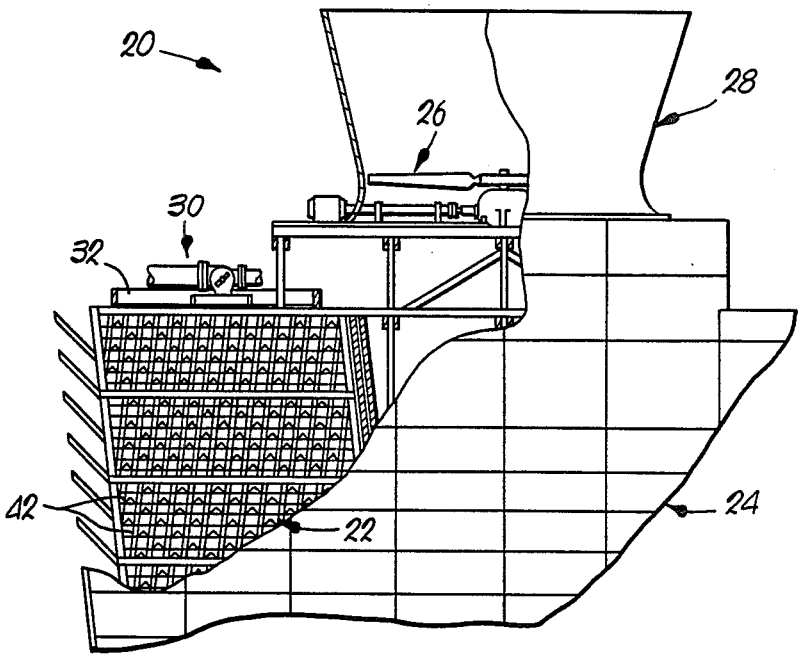
FIG. 1 is a fragmentary side elevational view of a mechanical draft water cooling tower with a portion of a tower casing cut away in section to illustrate fill structure comprising a number of splash bars connected to supporting grids by clips constructed in accordance with the invention.

Referring initially to FIG. 1, a cooling tower 20 is shown and includes fill structure 22 enclosed on each side by casing 24. A fan 26 draws air into the tower 20 and through the fill structure 22, and discharges the same in an upward direction through a fan cylinder 28. The water distribution system 30 includes a hot water basin 32 having spaced openings in the floor which receive respective nozzles that deliver droplets of water or small streams of hot water onto the underlying fill structure 22. The hot water is thus brought into contact with the crossflowing currents of air which are directed through the fill structure. Gradual cooling of water is accomplished as it progressively descends through the fill structure 22 whereupon it is collected in the cold water basin lying therebeneath.

Figure 2:
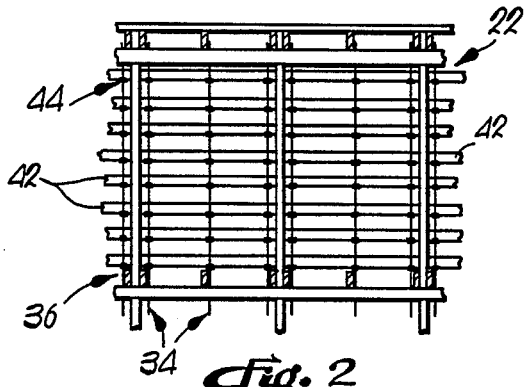
FIG. 2 is an enlarged, fragmentary end elevational view of a portion of the fill structure shown in FIG. 1.
Figure 3:
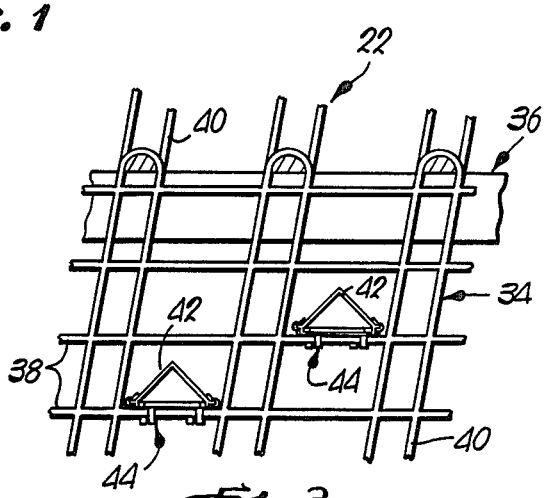
FIG. 3 is an enlarged, fragmentary side elevational view of the fill structure shown in FIG. 2.
Figure 4:
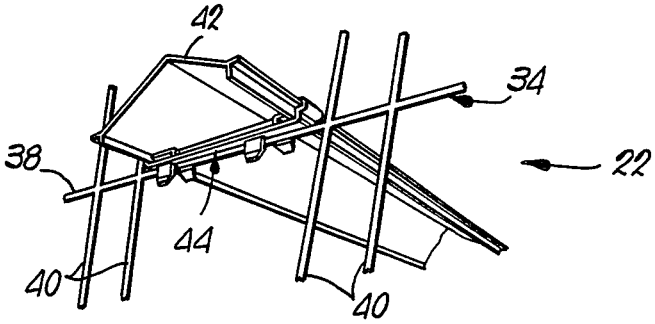
FIG. 4 is a fragmentary, enlarged, perspective view depicting the underside of one of the bars and illustrating in more detail the clip of the invention connecting the splash bar to the grid.

The fill structure 22 shown in more detail in FIGS. 2–4 is typical for a crossflow tower in that it includes a number of spaced, parallel, upright grids 34 that are secured in place by a framework 36. Each of the grids 34 is comprised of a lattice-type arrangement of spaced, parallel, horizontal grid members 38 fixed to a plurality of parallel, spaced bars 40 that are inclined relative to vertical, as shown in FIGS. 3 and 4. The grids 34 as depicted in FIGS. 2–4 may conveniently be fabricated from a glass fiber reinforced polyester material, with each member 38 thereby being integrally formed and thus secured to each bar 40 at every intersection of the same throughout the grid 34.

Viewing FIGS. 1–4, the fill structure 22 also includes an array of horizontally extending splash bars 42 made up of wooden slats, or more recently extruded shapes such as a part of an oval or an inverted V as depicted. Each of the splash bars 42 is interconnected to a section of one of the grid members 38 by means of a clip 44 which is also shown in FIGS. 5–9.

The preferred clip 44 of the present invention comprises an elongated body 46 having, on opposite ends, upper wall portions 48 (FIGS. 4 and 5) presenting a recess complemental in configuration to opposite, lower wall sections of the splash bars 42. The body 46 also includes a horizontally extending portion 50 beneath the recess receiving the lower sections of the splash bars 42. Four legs 52 depend from the horizontal portion 50 and are spaced along the length of the portion 50 on opposite sides of the same, as can be best appreciated by comparison of FIGS. 5 and 6. Legs 52 comprise releasable locking structure for receiving a selected section of a grid support member 38.

The legs 52 are arranged in pairs, with leg 52*a* of each pair disposed in an orientation opposite to the orientation of leg 52*b*. The cross-sectional configuration of each leg 52, however, is substantially identical and includes a vertical portion 54 extending downwardly from horizontal portion 50, and an inclined portion 56 that descends from the terminus of vertical portion 54. In addition, each leg 52 includes a protuberance 58, with the protuberance 58 of leg 52*a* extending in a direction opposite to and parallel to the direction of extension of protuberance 58 of leg 52*b*.

Figure 8:
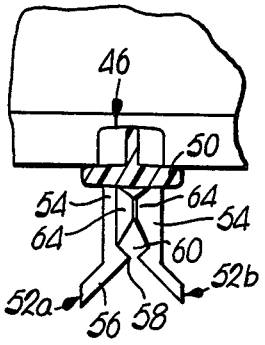
FIG. 8 is an enlarged, fragmentary cross-sectional view of the clip and a section of the splash bar before the legs of the clip are installed on the grid.

The horizontally extending, elongated channel 60 defined by legs 52 extends beneath horizontal portion 50 and is made up of the lower wall segment 62 of horizontal portion 50 of body 46, opposite inboard sides of the vertical portions 54 of legs 52*a*, 52*b*, and the inturned protuberances 58 of legs 52*a*, 52*b*. An element or tab 64 is connected to a marginal side edge segment of the vertical portion 54 of each leg 52 and is biased toward a normal orientation projecting into the channel 60 as shown in FIGS. 5–6 and 8.

Figure 5:
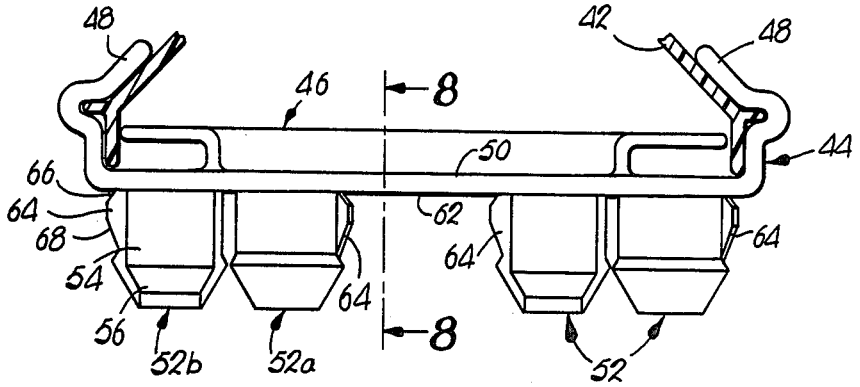
FIG. 5 is an enlarged, side elevational view of the clip of the present invention shown in FIGS. 2–4, with sections of the splash bar connected to upper wall portions of the clip.
Figure 6:
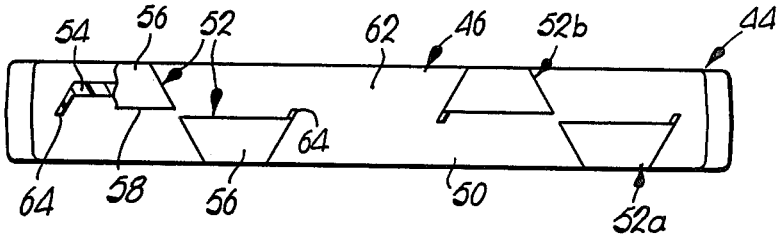
FIG. 6 is an enlarged bottom view of the clip illustrated in FIG. 4 with a portion of one of four legs of the clip broken away in section to illustrate the configuration of a resilient, deflectable tab that is connected to one side of the leg.
Figure 7:
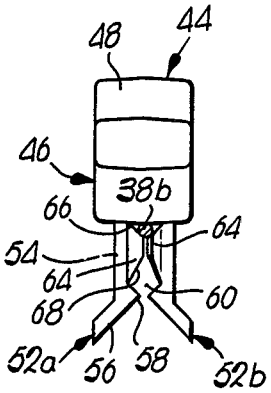
FIG. 7 is an enlarged end elevational view of the clip shown in FIGS. 2–6, depicting the orientation of the flexible tabs when a section of a stainless steel grid member is received within a channel between the clip legs.

Each of the tabs 64 is relatively thin in cross-section and includes an inclined upper edge 66 as best shown in FIGS. 5 and 7. The tabs 64 when in the orientation depicted in FIGS. 5–8 extend into the channel 60 and thereby limit the free or available cross-sectional area of the same. The available, free space of channel 60 above the upper edges 66 of tabs 64 and below the lower wall segment 62 of the horizontal portion 50 is of a size sufficient to receive a section of a stainless steel grid member 38*b* as is shown in FIG. 7.

Figure 9:
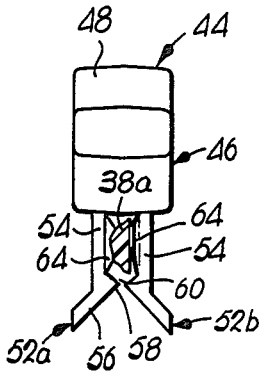
FIG. 9 is a view similar to FIG. 7 except that the clip is instead installed on a section of a grid member comprised of a glass reinforced polyester material, and the tabs connected to the clip legs have deflected laterally to accomodate the relatively large cross-sectional configuration of the grid member.

The tabs 64 are selectively shiftable relative to the legs 52 for movement away from the position shown in FIGS. 5–8. Specifically, the tabs 64 are deflectable in a lateral direction to thereby enlarge the available cross-sectional area of the channel 60 as may be necesary to accommodate a section of the glass fiber reinforced grid member 38*a* that is illustrated in FIG. 9.

In preferred forms of the invention, the clip 44 is integrally molded of a synthetic resinous material so that the relatively thin tabs 64 are inherently resilient. Thus, the tabs 64 self-deflect away from their normal orientation depicted in FIGS. 5–8 for reception of the glass fiber reinforced grid member 38*a* shown in FIG. 9 as the clip 44 is installed on the grid 34. Advantageously, a lower edge portion 68 (FIGS. 5 and 7–9) of each tab 64 is inclined relative to vertical for facilitating insertion of the grid member 38 into the channel 60 and self-deflection of the tab 64 in a lateral direction.

What is claimed is:

1. A device for securing a cooling tower splash bar to any one of a number of support grids each of which is provided with support member sections that are of cross-sectional dimensions which differ from one grid to another within a selected size range, said device comprising:

coupling means having components disposed to engage a respective splash bar for securing the latter to a grid support therefor;

releasable locking structure joined to said coupling means and having wall means defining a channel of dimensions sufficient to receive therein all sizes of said grid support member sections within said range thereof; and at least one resilient element connected to said structure in normal disposition projecting into the channel, said element being configured and arranged such that when a grid support member section of a smaller size within said range of selected sizes is inserted in the channel, the element first deflects to clear such grid support member section and then returns to its normal position projecting into the channel, the channel defining wall means and the element in said normal disposition thereof being located in cooperable relationship such that they releasably hold said smaller grid support member section in the locking structure after insertion of the smaller grid support member section in the channel, the element further being deflectable away from said normal position of the same projecting into the channel to an extent as required to clear a grid support member section of a larger size within said selected range of sizes thereof during insertion of said larger size grid support member section into the channel and to engage the larger size grid support member section in cooperation with the channel defining wall means for releasably retaining the larger size grid support member section in the locking structure.

2. The invention as set forth in claim 1, wherein the element is located and positioned such that a smaller grid support member section inserted in the channel rests on the element in the normal position thereof projecting into the channel and is deflected and rests against the side of a larger grid support member section in frictional engagement with the latter when a larger size of grid support member section is inserted into the locking structure.

3. The invention as set forth in claim 2, wherein said at least one element has a lower edge portion extending in a direction inclined from horizontal for facilitating self-shifting of said at least one element away from said certain orientation as a grid member section is inserted in said channel.

4. The invention as set forth in claim 1, wherein said releasable locking structure is selectively movable relative to said coupling means.

5. A device for securing a cooling tower splash bar to a generally horizontal section of either one of two grid members having different, respective cross-sectional configurations comprising:

a body having upper wall portions engageable with the splash bar for supporting the same, said body including a lower wall segment for contact with a selected one of said grid member sections;

leg means depending from said body and cooperatively defining with said lower wall segment a channel below said body for receiving the selected grid member section in generally surrounding relationship to the latter; and at least one element connected to said leg means and selectively shiftable relative to the latter for movement toward and away from a certain orientation projecting into said channel, said channel when said at least one element is in said certain orientation having a free cross-sectional area of a certain value sufficient for receiving one of said grid member sections, said channel when said at least one element is shifted away from said certain orientation having free cross-sectional area of a value larger than said certain value as may be necessary to receive the other of said grid member sections.

6. The invention as set forth in claim 5, wherein said leg means comprises at least one pair of legs spaced along the length of said channel and defining opposite side regions of said channel, each of said legs being integrally connected to and carrying a respective one of said at least one element.

7. The invention as set forth in claim 5, wherein said at least one element includes an upper edge portion spaced from said lower wall segment for reception of one of said two grid members sections therebetween.

* * * * *